US005988575A

United States Patent [19]

Lesko

[11] Patent Number: 5,988,575

[45] Date of Patent: Nov. 23, 1999

[54] AEROSOL SPRAY CAN TOOL

[76] Inventor: Joseph John Lesko, 3419 Via Lido Ste 204, Newport Beach, Calif. 92663

[21] Appl. No.: 08/681,821

[22] Filed: Jul. 29, 1996

[51] Int. Cl.[6] ..... A47B 96/06

[52] U.S. Cl. ..... 248/213.2; 248/214; 248/316.7; 211/60.1; 24/339; 222/543

[58] Field of Search ..... 248/213.2, 214, 248/229.16, 229.26, 230.7, 231.81, 316.7; 211/60.1; D8/373.5, 382, 384, 383, 394, 395, 396; D32/73; 24/339; 222/543, 530, 538, 473, 408

[56] References Cited

U.S. PATENT DOCUMENTS

| | | | |
|---|---|---|---|
| 845,224 | 2/1907 | Eibel . | |
| 1,903,410 | 4/1933 | Cecil . | |
| 2,892,565 | 6/1959 | Faini | 222/543 |
| 4,141,445 | 2/1979 | Korich | 206/228 |
| 4,232,785 | 11/1980 | Lucas | 206/228 |
| 4,823,445 | 4/1989 | Diener | 222/538 |
| 5,289,961 | 3/1994 | Levitt | 224/247 |
| 5,544,783 | 8/1996 | Conigliaro | D8/396 |

*Primary Examiner*—Leslie A. Braun
*Assistant Examiner*—Kimberly Wood
*Attorney, Agent, or Firm*—Stetina Brunda Garred & Brucker

[57] ABSTRACT

The Aerosol Spray Can Tool is a device that holds and stores certain accessories and vital parts of the common aerosol spray can. It is a flexible bracelet that snaps around the can and it has holes thru it, slots, clips and a suitcase. The holes hold the spray straw, the slots hold the spray straw and the clip holds the spray straw. The suitcase molded or machined with the bracelet stores the spray nozzle. A very long straw is laced thru two or more holes to store the long straw.

1 Claim, 6 Drawing Sheets

AEROSOL SPRAY CAN TOOL

FIELD OF THE INVENTION

This invention relates to an aerosol spray can utilizing an extension spray tube and, more particularly, is directed towards such a holder that stores an extension tube, 08.085 inches in diameter and up to six inches long, a spray nozzle, and the cap or cover of a can that protects the spray nozzle from getting lost, destroyed or accidentally pushed thereby discharging fluids or powders.

BACKGROUND OF THE INVENTION

This application is an updated and improved version of an application I filed on Jan. 30, 1991, and was abandoned. The present invention is a way to store a spray tube nozzle extension that is attached to the side of an aerosol can by the manufacturer. The manufacturer attaches the tube to the can with Scotch® tape or a rubber band. If the spray tube is left in the spray nozzle by the user, it gets lost very soon. If it is re-attached to the side of the can, the contents of the can, usually a petroleum distillate, destroys the Scotch® tape or rubber band.

When the extension tube is lost, then the operator must spray without the aid of the extension tube, thus resulting in overspray, and spraying parts that will be harmed by the overspray, such as in the electronic field. The overspray fouls the environment, and even potentially injures oneself or others by ignition of the overspray.

When the spray nozzle is lost the owner usually discards the entire unused portion of the remaining petroleum distillate, fouling the landfills and environment.

When the aerosol can cover or cap gets lost, the can becomes a very deadly object. When an aerosol can is carried in the trunk of a car or a work van, the can may be pushed against an object, thereby activating the spray nozzle, and discharging the contents of the aerosol can in the enclosed vehicle, rendering the operator unconscious or causing an explosion if the operator is smoking.

Clearly, then, there is a need for an aerosol spray can tool that eliminates the loss of parts on or attached to the present aerosol spray can. The tool needed would be relatively inexpensive to manufacture, and would be easy to install on the aerosol can. The needed invention would prevent unused portions of petroleum distillate, paints, varnishes, cleaning solutions, silicones, insecticides, and disinfectants to be atomized wastefully, in the atmosphere, discarded in the landfills and, with excessive overspray, inhaled.

SUMMARY OF THE INVENTION

The present invention is a tool for the aerosol can. The present device is a band constructed from a chemical resistant thermoplastic, thermoset compound, or an alloy. Such a device is a partial cylindrical band frictionally engaged helically around the outer circumference of the aerosol can. Such a band contains mounting and fastening features to store the spray can nozzle tip, extension tubes and secure the can's cover or lid. It would also be transferable from container to container. Also with the band, I have invented a way to spray a liquid from a container on objects far away or in confined spaces unreachable with the existing generic spray extension tube. Just as U.S. Pat. No. 845,224 clearly states and illustrates by extending one end of post "B" on FIG. 1, which enabled an operator of said machine or device to improve said machine's or device's efficiency, I extended one end of the generic extension tube to improve its efficiency. The long extension tube and its storage facility was invented when I tried to spray a carburetor cleaner into the air-intake aperture of the carburetor of my six cylinder 1982 Ford van. I found it to be impossible due to the firewall blocking the accessibility. The generic spray tube did not reach the air intake aperture, causing me to overspray and causing unwanted carburetor cleaner to foul the interior of my van and outside atmosphere. The only means of getting the generic spray straw into the opening of the carburetor was to lay the can of aerosol cleaner on its side and bend the generic straw downward. When I performed this act, two things occurred: one was that when the can was half empty I sprayed no liquids due to the construction of the aerosol can, only projectile gases escaped; and two, the generic spray tube kinked and shut off the liquid supply and/or projectile gases. The other reason I invented the long spray extension tube and its storage facility was the fact that I could not spray a lubricant onto the automatic transmission linkage on my 1969 Ford Van. Every time it rained the linkage would freeze up due to the lubricants being washed away by the rains. The said linkage was behind the fixed grill of the 1969 Ford Van. There was no way to lubricate the linkage from underneath because there is a protective sheet of metal placed there by the manufacturer. I found it next to impossible to shift gears during the rainy season in Southern California. It was imperative for me to lubricate the linkage, so I oversprayed an entire can of lubricant with the short generic spray tube, spraying most of the petroleum distillate into the atmosphere. If it becomes necessary to spray something that is inaccessible for the human hand to guide the long spray straw to spray, I have invented a Spray-tube Guide.

The needed invention would prevent much needed parts or accessories of the aerosol can from becoming broken, lost, misplaced or accidently activating the action of the spray nozzle.

The present invention fulfills these needs and provides related advantages. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the inventions. In such drawings.

DETAILED DESCRIPTION OF THE PREFERRED EMBODIMENT

Figure 1:
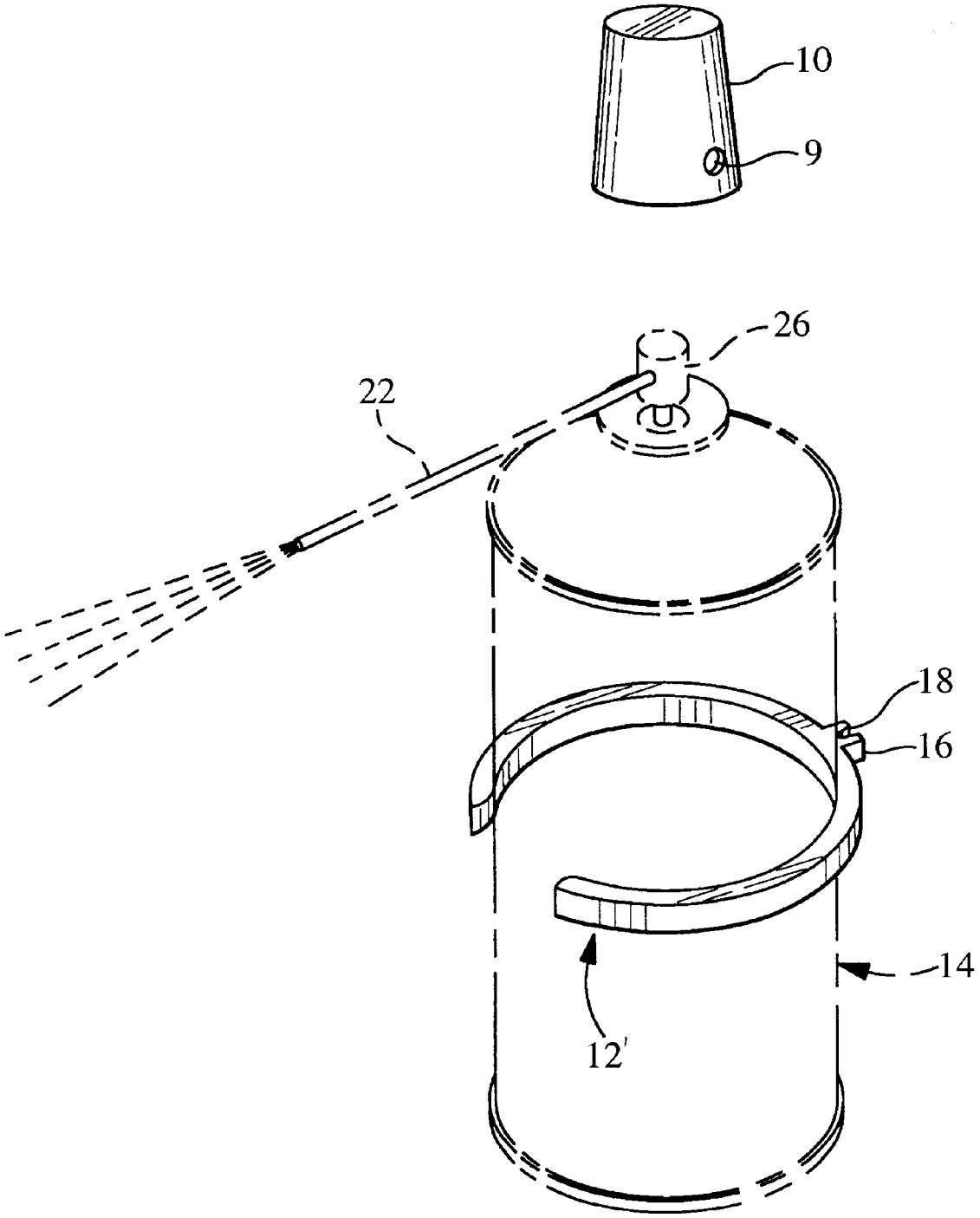
Fig. 1 (PRIOR ART)
FIG. 1 perspectively illustrates a prior art band for retaining a straw on an aerosol can.

FIG. 1 shows the a prior art Band 12' frictionally held around the circumference of an Aerosol Can 14. The Extension Tube 22 is frictionally fit into Spray Nozzle 26. The Cap 10 or Cover 10 of Can 14 is illustrated as being off of can.

Figure 2:
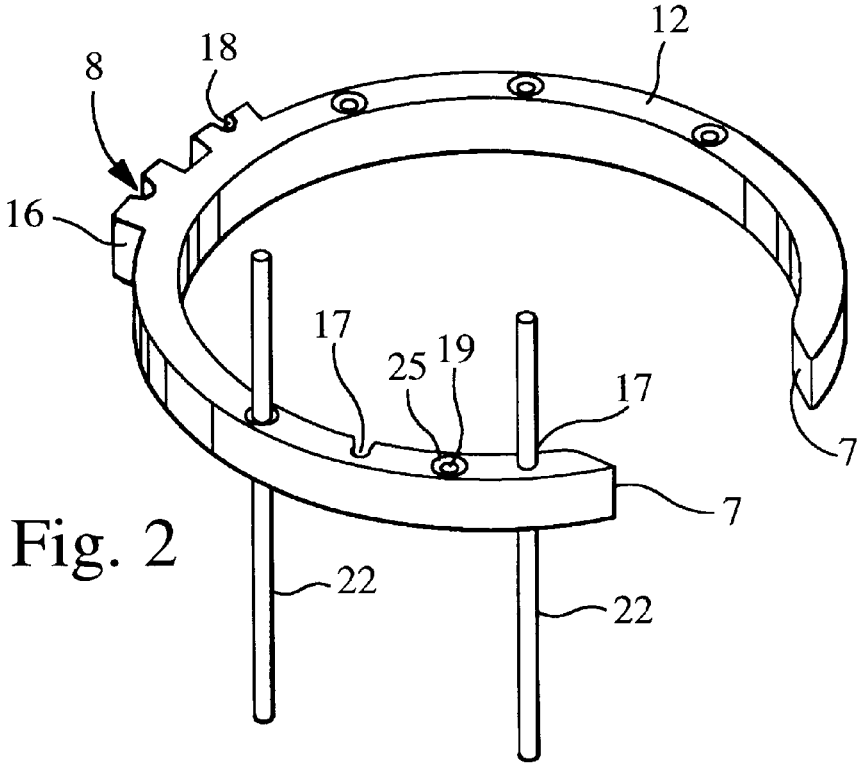
FIG. 2 perspectively illustrates a band constructed in accordance with a first embodiment of the present invention and configured to retain aerosol can tools.

FIG. 2 shows a first embodiment of a Band 12 constructed in accordance with the present invention and frictionally securing two Generic Spray Extension Tubes 22. One tube is secured by Aperture 19 in the center of the Band 12 and the other 14 extension tube is frictionally secured by Slot 17 on the interior side of the band. Slot 17 is molded at 0.085 in depth and width so that the aerosol can wall will hold it secure. The extension tube 22 in Aperture 19 is secured by a "Bump" 20 as illustrated in FIG. 6B.

Figure 3:
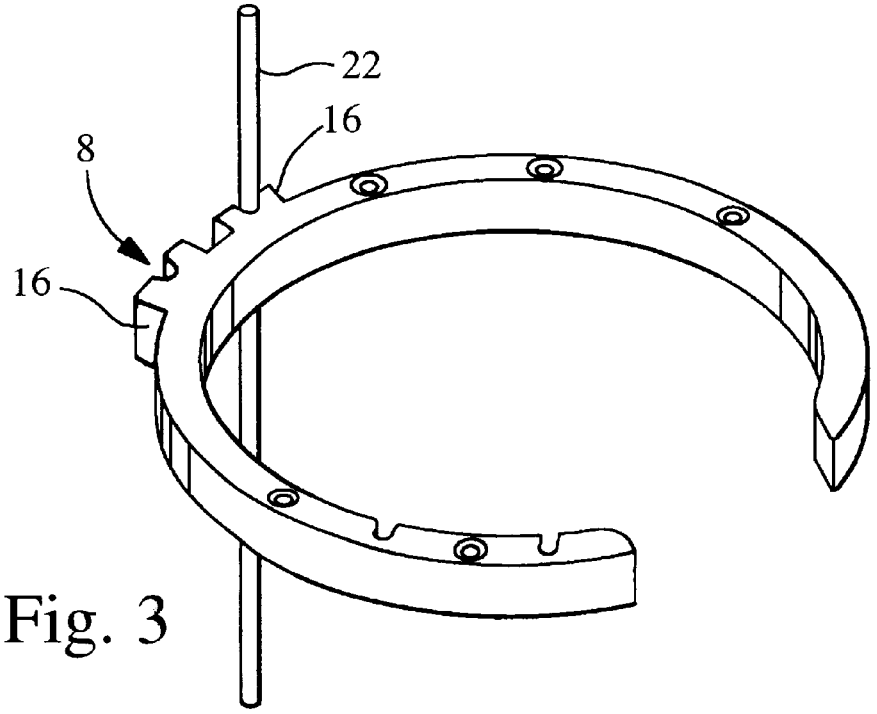
FIG. 3 perspectively illustrates the band shown in FIG. 1 retaining an aerosol can straw.

FIG. 3 shows Generic Extension Tube 22 frictionally secured by External Clip 16 with friction at Point 18. The distance between the two Points at 18 is 0.080 of an inch. The walls at 16 flex when Extension Tube 22 enters at Entry Point 8.

Figure 4:
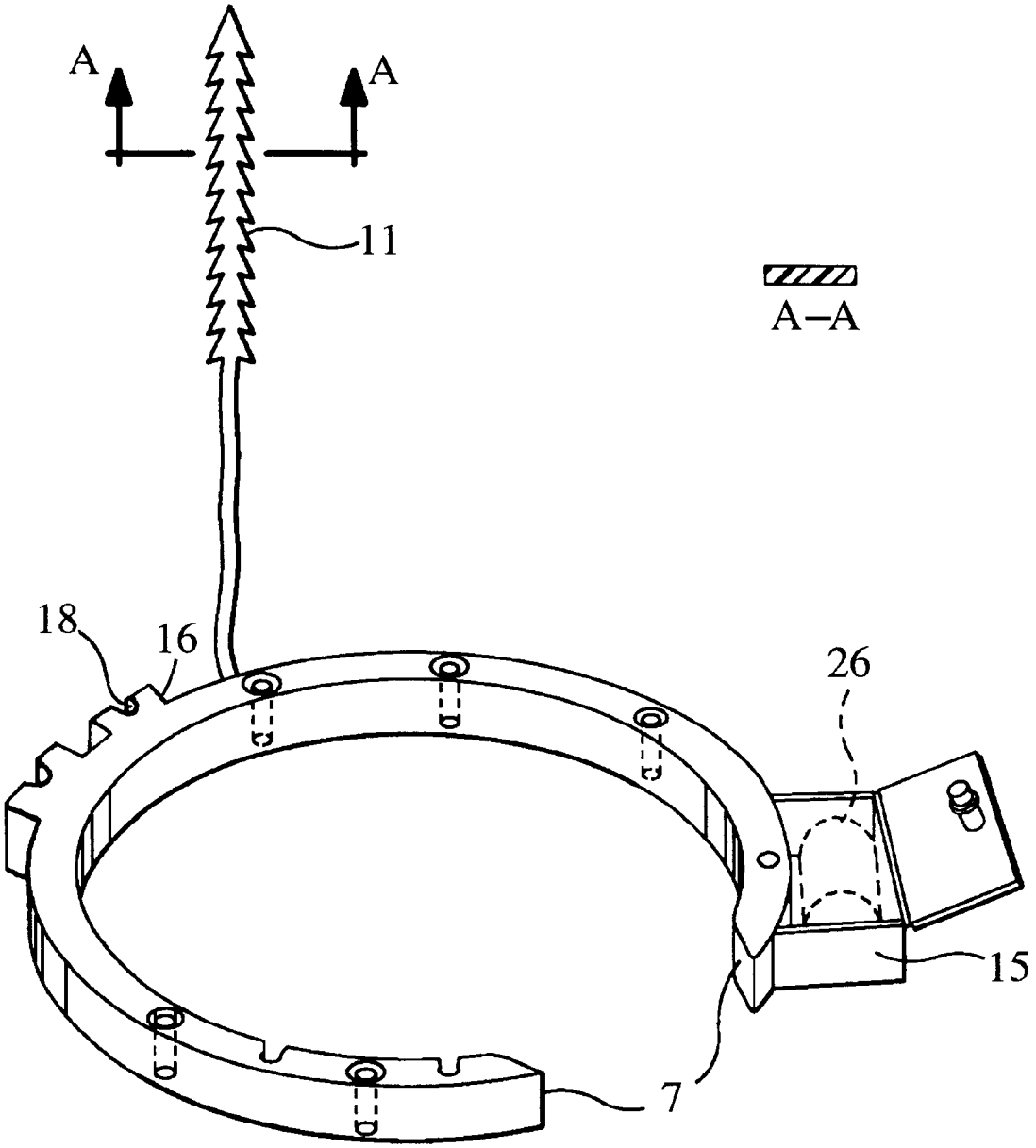
FIG. 4 perspectively illustrates a band constructed in accordance with a second embodiment of the present invention and configured to retain aerosol can tools.

FIG. 4 shows Sprayhead 26 inside Suitcase 15. Strap 11 shows how it is molded very thin at View A.A., making it flexible and agile to secure Cap 10 thru Aperture 9. Aperture 9 is illustrated in FIG. 1. The Acute Angles 7 enable Band 12 easy entry onto Can 14. At External Clip 16 the Friction Gripper 18 is illustrated.

Figure 5:
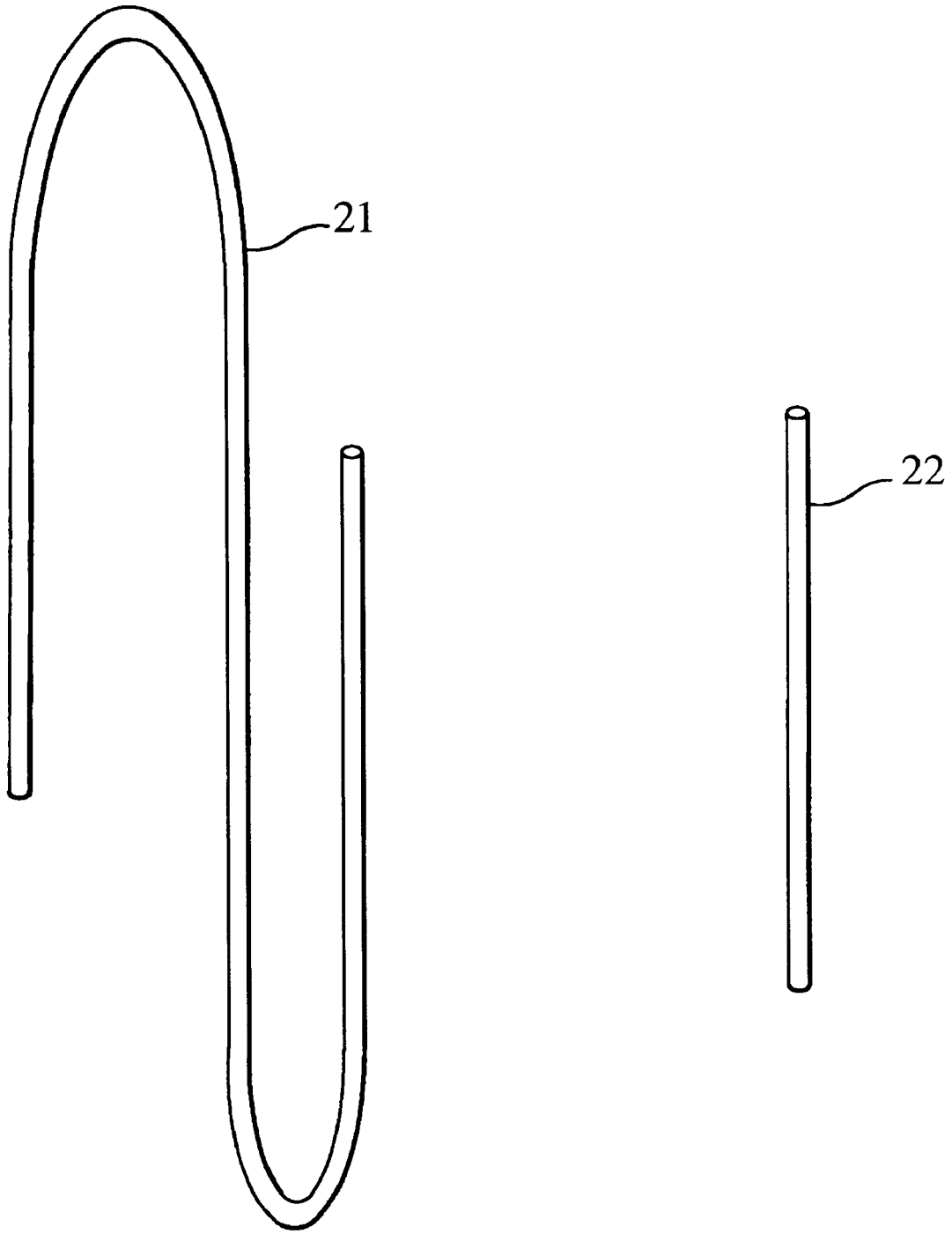
FIG. 5 is a plan view of aerosol can straws.

FIG. 5 shows two spray extension tubes. The Extension Tube 22 is generic, the other Spray Tube 21 is not generic as prior art clearly illustrates.

Figure 6A:
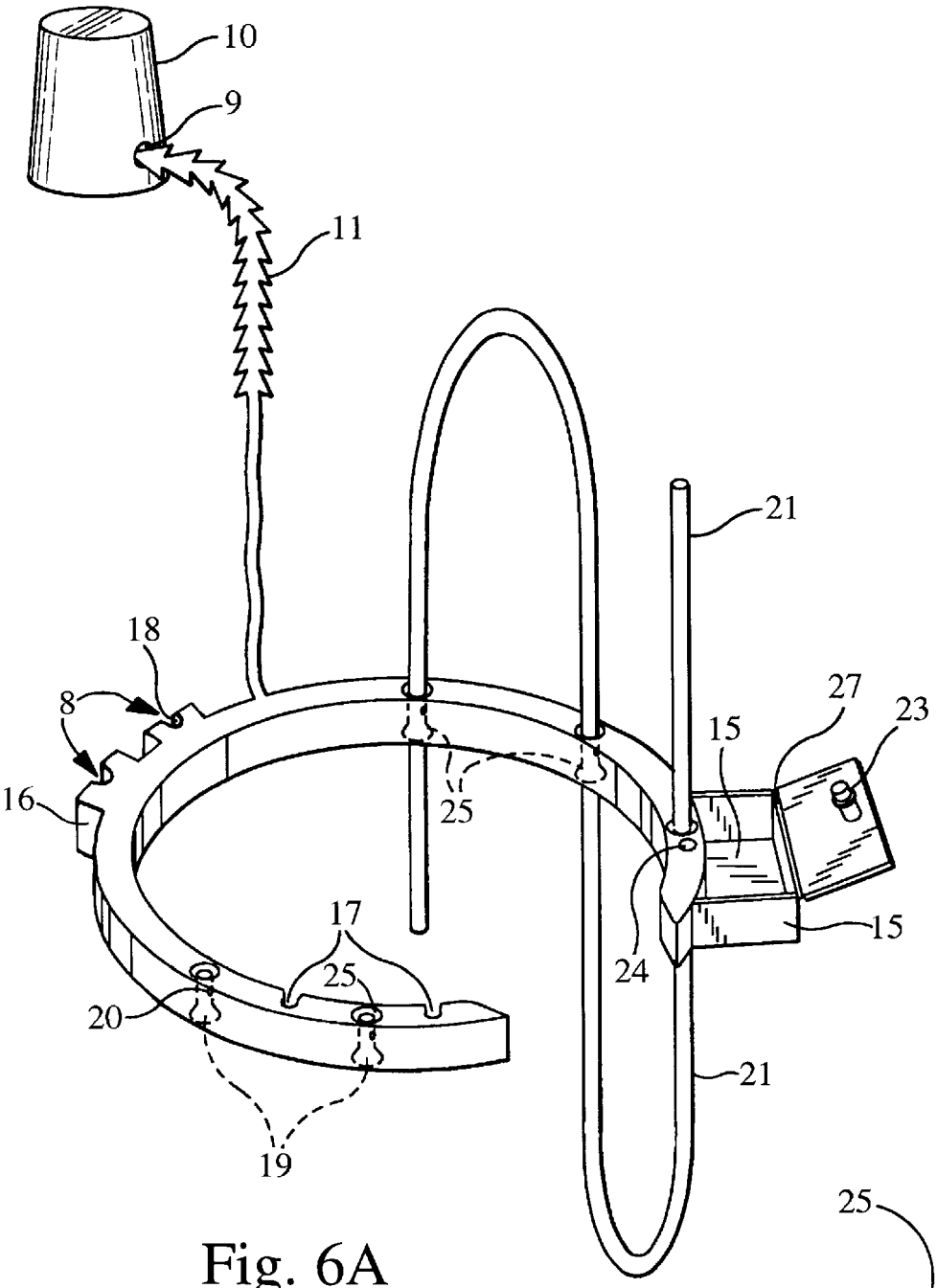
FIG. 6A perspectively illustrate the band shown in FIG. 4 retaining a straw and cap.
Figure 6B:
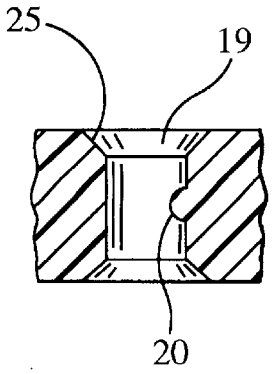
FIG. 6B is a plan view of a straw retainer shown for the band of FIGS. 1 and 4.

FIG. 6A shows the Superstraw 21 being "laced" thru Apertures 19 for storage.

Figure 7A:
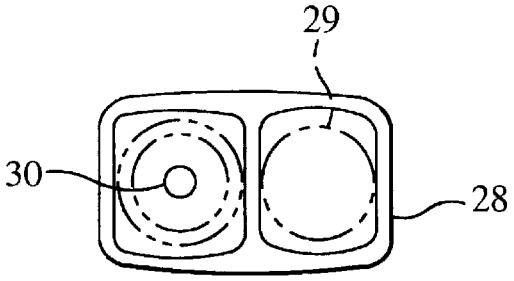
FIG. 7A is a cross-sectional plan view of a spray tube guide retaining a straw and clothes hanger wire.
Figure 7B:
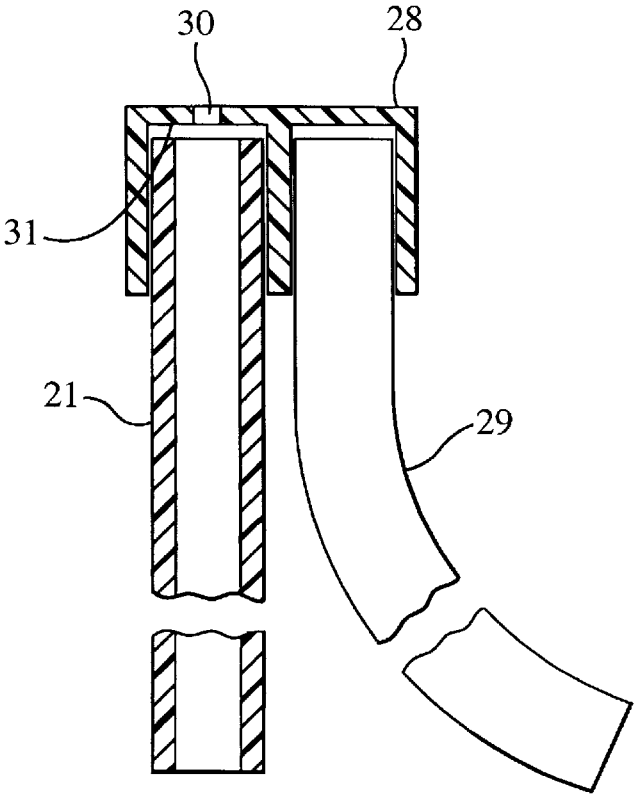
FIGS. 7B and 7C are cross-sectional top-views of the spray tube guide shown in FIG. 7A.
Figure 7C:
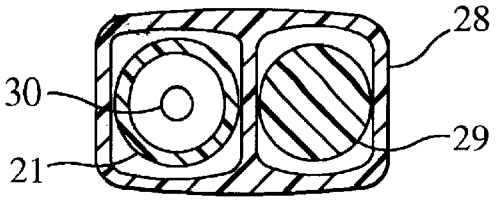

FIGS. 7A–7B shows long Spray Straw 21 and a generic Clothes Hanger Wire 29 being frictionally fit inside of Spray Tube Guide 28. The Spray Tube Guide can be stored in Suitcase 15. As seen in FIG. 6B, Aperture 19 has Chamfer 25 for easy lacing. Bump 20 is shown in the exploded view at FIG. 6B. The core pin in the mold has a 0.002 undercut and Aperture 19 is molded at 0.086 diameter. Suitcase 15 is shown open illustrating how easily it is molded in FIG. 6B. Living Hinge 27 is shown. Male Snap-lock 23 enters female Snap-lock 24 to keep it secure. Nos. 23 and 24 are mated by friction. Lid 10 is secured to Band 12 by Strap 11 entering Aperture 9 and held mechanically as shown.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A device for holding an aerosol can spray tube member, said device being formed of an arcuate band member having a first and second end, an inner arcuate surface, an outer arcuate surface and co-planar top and bottom surfaces, a plurality of apertures extending from the top surface to the bottom surface for holding a tube member, each of the apertures having a bump for maintaining the tube in each of the apertures, said outer surface having at least one exterior extension tube holder clip with an extension tube hold friction grip means adapted to secure the tube member thereto, said outer surface having a strap member having a first and second end, the first strap end being secured to said outer surface and said second strap end adapted to be secured to a cap or cover of the aerosol can, and said outer surface having a receptacle secured thereto, said receptacle having a lid pivotable secured thereto, said receptacle adapted to house a spray head of the aerosol can.

* * * * *